US009514762B2

(12) United States Patent
Miao et al.

(10) Patent No.: US 9,514,762 B2
(45) Date of Patent: Dec. 6, 2016

(54) AUDIO SIGNAL CODING METHOD AND APPARATUS

(71) Applicant: HUAWEI TECHNOLOGIES CO.,LTD., Shenzhen, Guangdong (CN)

(72) Inventors: Lei Miao, Beijing (CN); Zexin Liu, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 15/011,824

(22) Filed: Feb. 1, 2016

(65) Prior Publication Data

US 2016/0148622 A1 May 26, 2016

Related U.S. Application Data

(63) Continuation of application No. 14/145,632, filed on Dec. 31, 2013, now Pat. No. 9,251,798, which is a (Continued)

(30) Foreign Application Priority Data

Oct. 8, 2011 (CN) ..... 2011 1 0297791

(51) Int. Cl.
*G10L 19/00* (2013.01)
*G10L 19/26* (2013.01)
(Continued)

(52) U.S. Cl.
CPC ..... *G10L 19/265* (2013.01); *G10L 19/008* (2013.01); *G10L 19/0204* (2013.01);
(Continued)

(58) Field of Classification Search
USPC ..... 704/200–232, 500–504
See application file for complete search history.

(56) References Cited

U.S. PATENT DOCUMENTS 6,134,518 A * 10/2000 Cohen ..... G10L 19/18 704/201
2003/0142746 A1 7/2003 Tanaka et al.
(Continued)

FOREIGN PATENT DOCUMENTS

CN 1498396 A 5/2004
CN 1942928 A 4/2007
(Continued)

OTHER PUBLICATIONS

Neuendorf et al. "Unified Speech and Audio Coding Scheme for High Quality at Low BitRates". IEEE Int. Conf. on Acoustics, Speech, and Signal Proc., 2009.*
(Continued)

*Primary Examiner* — Jesse Pullias
(74) *Attorney, Agent, or Firm* — Huawei Technologies Co., Ltd.

(57) ABSTRACT

The present invention relates to an audio signal coding method and apparatus. The method includes: categorizing audio signals into high-frequency audio signals and low-frequency audio signals; coding the low-frequency audio signals by using a corresponding low-frequency coding manner according to characteristics of low-frequency audio signals; and selecting a bandwidth extension mode to code the high-frequency audio signals according to the low-frequency coding manner and/or characteristics of the audio signals.

29 Claims, 6 Drawing Sheets

Related U.S. Application Data continuation of application No. PCT/CN2012/072792, filed on Mar. 22, 2012.

(51) Int. Cl.

| | |
|---|---|
| ***G10L 19/18*** | (2013.01) |
| ***G10L 21/038*** | (2013.01) |
| ***G10L 19/008*** | (2013.01) |
| ***G10L 19/02*** | (2013.01) |
| ***G10L 19/087*** | (2013.01) |
| *G10L 25/18* | (2013.01) |

(52) U.S. Cl.

CPC ..... *G10L 19/087* (2013.01); *G10L 19/18* (2013.01); *G10L 21/038* (2013.01); *G10L 25/18* (2013.01)

(56) References Cited

U.S. PATENT DOCUMENTS

| | | | |
|---|---|---|---|
| 2004/0064311 | A1 | 4/2004 | Sinha et al. |
| 2005/0108009 | A1 | 5/2005 | Lee et al. |
| 2005/0246164 | A1 | 11/2005 | Ojala et al. |
| 2006/0149538 | A1 | 7/2006 | Lee et al. |
| 2006/0282262 | A1 | 12/2006 | Vos et al. |
| 2007/0299656 | A1 | 12/2007 | Son et al. |
| 2009/0107322 | A1 | 4/2009 | Akiyama |
| 2010/0017202 | A1 | 1/2010 | Sung et al. |
| 2010/0094638 | A1 | 4/2010 | Lee et al. |
| 2010/0274555 | A1 | 10/2010 | Laaksonen et al. |
| 2011/0099018 | A1* | 4/2011 | Neuendorf ..... G10L 21/038 704/500 |
| 2011/0196686 | A1 | 8/2011 | Oshikiri |
| 2011/0264457 | A1 | 10/2011 | Oshikiri et al. |
| 2012/0010880 | A1* | 1/2012 | Nagel ..... G10L 19/18 704/205 |
| 2012/0243526 | A1 | 9/2012 | Yamamoto et al. |

FOREIGN PATENT DOCUMENTS

| | | | |
|---|---|---|---|
| CN | 101140759 | A | 3/2008 |
| CN | 101572087 | A | 11/2009 |
| CN | 101896968 | A | 11/2010 |
| CN | 102150200 | A | 8/2011 |
| EP | 2056294 | A2 | 5/2009 |
| EP | 2302345 | A1 | 3/2011 |
| JP | 2006293400 | A | 10/2006 |
| JP | 2007532963 | A | 11/2007 |
| JP | 2009104015 | A | 5/2009 |
| JP | 2009541790 | A | 11/2009 |
| JP | 2011514558 | A | 5/2011 |
| WO | 02058052 | A1 | 7/2002 |
| WO | 2005040749 | A1 | 5/2005 |
| WO | 2005101372 | A1 | 10/2005 |
| WO | 2006049204 | A1 | 5/2006 |
| WO | 2011043227 | A1 | 4/2011 |

OTHER PUBLICATIONS

Nagel et al. "A Harmonic Bandwidth Extension Method for Audio Codecs". IEEE Int. Conf. on Acoustics, Speech, and Signal Proc., 2009.*

Ludovic Tancerel et al: "Combined Speech and audio coding by discrimination", speech coding, 2000 IEEE workshop on Sep. 17-20, 2000, total 4 pages.

"G.729-based embedded variable bit-rate coder: An 8-32 kbit/s scalable wideband coder bitstream interoperable with G.729", ITU-T Recommendation G.729.1, May 2006, total 100 pages.

"Wideband embedded extension for G.711 PCM: New Annex D with superwideband extension Amendment 4", ITU-T Recommendation G.711.1 Amendment 4, Nov. 2010, total 74 pages.

"7 kHz audio-coding within 64 kbit/s: New Annex B with superwideband embedded extension Amendment 1", ITU-T Recommendation G.722 Amendment 1, Nov. 2010, total 96 pages.

* cited by examiner

AUDIO SIGNAL CODING METHOD AND APPARATUS

CROSS-REFERENCE TO RELATED APPLICATIONS

This application is a continuation of U.S. application Ser. No. 14/145,632, filed on Dec. 31, 2013, which is a continuation of International Application No. PCT/CN2012/072792, filed on Mar. 22, 2012, which claims priority to Chinese Patent Application No. 201110297791.5, filed on Oct. 8, 2011, the afore-mentioned patent applications are hereby incorporated by reference in their entireties.

FIELD OF THE INVENTION

The present invention relates to the field of communications, and in particular, to an audio signal coding method and apparatus.

BACKGROUND OF THE INVENTION

During audio coding, considering the bit rate limitation and audibility characteristics of human ears, information of low-frequency audio signals is preferably coded and information of high-frequency audio signals is discarded. However, with the rapid development of the network technology, the network bandwidth limitation is being reduced. Meanwhile people's requirements for the timbre are higher and higher, and people desire to restore the information of the high-frequency audio signals by adding the bandwidth for the signals. In this way, the timbre of the audio signals is improved. Specifically, this may be implemented by using bandwidth extension (BandWidth Extension, BWE) technologies.

Bandwidth extension may extend the frequency scope of the audio signals and improve signal quality. At present, the commonly used BWT technologies include, for example, the time domain (Time Domain, TD) bandwidth extension algorithm in G.729.1, the spectral band replication (Spectral Band Replication. SBR) technology in moving picture experts group (Moving Picture Experts Group, MPEG), and the frequency domain (Frequency domain, FD) bandwidth extension algorithm in International Telecommunication Union, ITU-I) G.722B/G.722.1D.

FIG. 1 and FIG. 2 are schematic diagrams of bandwidth extension in the prior art. That is, no matter whether the low-frequency (for example, smaller than 6.4 kHz) audio signals use time domain coding (TD coding) or frequency domain coding (FD coding), the high-frequency (for example, 6.4-16/14 kHz) audio signals use time domain bandwidth extension (TD-BWE) or frequency domain bandwidth extension (FD-BWE) for bandwidth extension.

In the prior art, only time domain coding of the time domain bandwidth extension or frequency domain coding of the frequency domain bandwidth extension is used to code the high-frequency audio signal, without considering the coding manner of the low-frequency audio signal and the characteristics of the audio signal.

SUMMARY OF THE INVENTION

Embodiments of the present invention provide an audio signal coding method and apparatus, which are capable of implementing adaptive coding instead of fixed coding.

An embodiment of the present invention provides an audio signal coding method, where the method includes:

categorizing audio signals into high-frequency audio signals and low-frequency audio signals;

coding the low-frequency audio signals by using a corresponding low-frequency coding manner; and selecting a bandwidth extension mode to code the high-frequency audio signals according to the low-frequency coding manner and/or characteristics of the audio signals.

An embodiment of the present invention provides an audio signal coding apparatus, where the apparatus includes:

a categorizing unit, configured to categorize audio signals into high-frequency audio signals and low-frequency audio signals;

a low-frequency signal coding unit, configured to code the low-frequency audio signals by using a corresponding low-frequency coding manner; and a high-frequency signal coding unit, configured to select a bandwidth extension mode to code the high-frequency audio signals according to the low-frequency coding manner and/or characteristics of the audio signals.

According to the audio signal coding method and apparatus in the embodiments of the present invention, the coding manner for bandwidth extension to the high-frequency audio signals may be determined according to the coding manner of the low-frequency audio signals and/or the characteristics of the audio signals. In this way, a case that the coding manner of the low-frequency audio signals and the characteristics of the audio signals are not considered during bandwidth extension can be avoided, bandwidth extension is not limited to a single coding manner, adaptive coding is implemented, and audio coding quality is improved.

DETAILED DESCRIPTION OF THE EMBODIMENTS

The following describes the technical solutions of the present invention in combination with the accompanying drawings and embodiments.

According to the embodiments of the present invention, whether time domain bandwidth extension or frequency domain bandwidth extension is used in frequency band extension may be determined according to a coding manner of low-frequency audio signals and characteristics of audio signals.

In this way, when low-frequency coding is time domain coding, the time domain bandwidth extension or frequency domain bandwidth extension may be used for high-frequency coding; when the low-frequency coding is frequency domain coding, the time domain bandwidth extension or frequency domain bandwidth extension may be used for the high-frequency coding.

Figure 1:
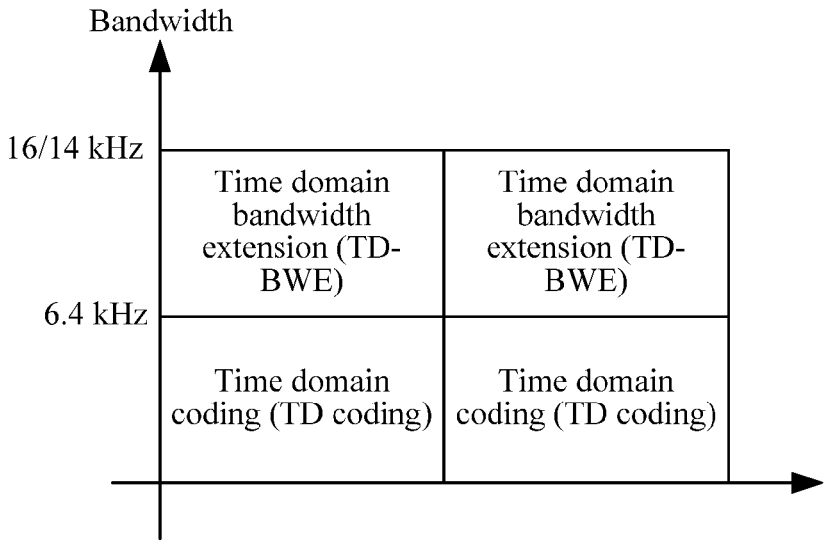
FIG. 1 (Prior Art)
FIG. 1 is a first schematic diagram of bandwidth extension in the prior art.
Figure 2:
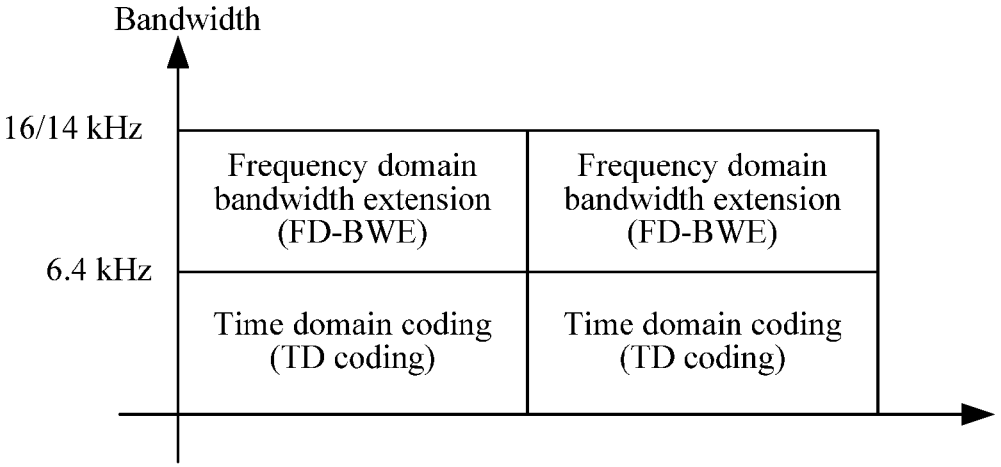
FIG. 2 (Prior Art)
FIG. 2 is a second schematic diagram of bandwidth extension in the prior art.
Figure 3:
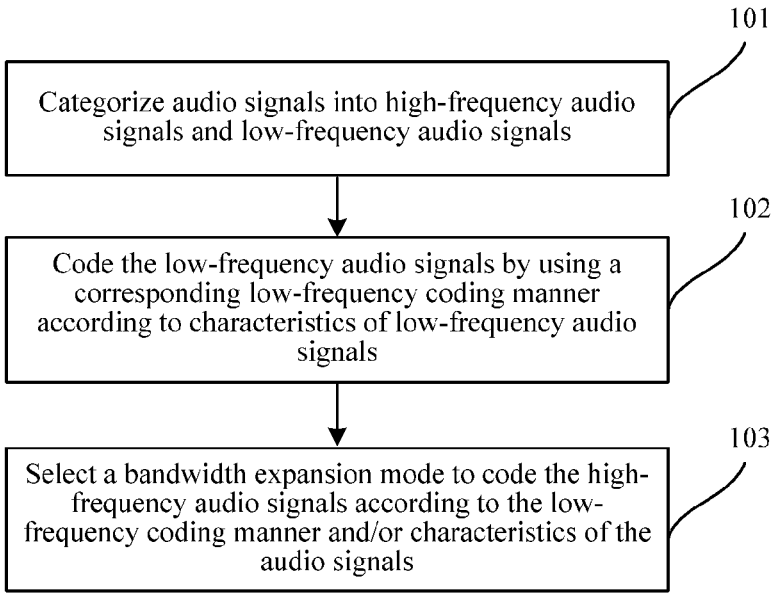
FIG. 3 is a flowchart of an audio signal coding method according to an embodiment of the present invention.

FIG. 3 is a flowchart of an audio signal coding method according to an embodiment of the present invention. As shown in FIG. 3, the audio signal coding method according to this embodiment of the present invention specifically includes the following steps:

Step 101: Categorize audio signals into high-frequency audio signals and low-frequency audio signals.

The low-frequency audio signals need to be directly coded, whereas the high-frequency audio signals must be coded through bandwidth extension.

Step 102: Code the low-frequency audio signals by using a corresponding low-frequency coding manner according to characteristics of the low-frequency audio signals.

The low-frequency audio signals may be coded in two manners, that is, time domain coding or frequency domain coding. For example, as regard voice audio signals, low-frequency voice signals are coded by using time domain coding; as regard music audio signals, low-frequency music signals are coded by using frequency domain coding. Generally, a better effect is achieved when voice signals are coded by using time domain coding, for example, code excited linear prediction (Code Excited Linear Prediction, CELP); whereas a better effect is achieved when music signals are coded by using frequency domain coding, for example, modified discrete cosine transform (Modified Discrete Cosine Transform, MDCT) or fast Fourier transform (Fast Fourier Transform, FFT).

Step 103: Select a bandwidth extension mode to code the high-frequency audio signals according to the low-frequency coding manner or characteristics of the audio signals.

This step describes several possibilities in the case of coding the high-frequency audio signals: first, determining a coding manner of the high-frequency audio signals according to the coding manner of the low-frequency audio signals; second, determining the coding manner of the high-frequency audio signals according to the characteristics of the audio signals; third, determining the coding manner of the high-frequency audio signals according to both the coding manner of the low-frequency audio signals and the characteristics of the audio signals.

The coding manner of the low-frequency audio signals may be the time domain coding or the frequency domain coding. However, the characteristics of the audio signals may be voice audio signals or music audio signals. The coding manner of the high-frequency audio signals may be a time domain bandwidth extension mode or a frequency domain bandwidth extension mode. As regard bandwidth extension of the high-frequency audio signals, coding needs to be performed according to the coding manner of the low-frequency audio signals or the characteristics of the audio signals.

A bandwidth extension mode is selected to code the high-frequency audio signals according to the coding manner of the low-frequency audio signal or the characteristics of the audio signals. The selected bandwidth extension mode corresponds to the low-frequency coding manner or the characteristics of the audio signals, the selected bandwidth extension mode and the low-frequency coding manner belonging to the same domain coding manner or the selected bandwidth extension mode and the characteristics of the audio signals belonging to the same domain coding manner.

In an embodiment, the selected bandwidth extension mode corresponds to the low-frequency coding manner: When the low-frequency audio signals should be coded by using the time domain coding manner, the time domain bandwidth extension mode is selected to perform time domain coding for the high-frequency audio signals; when the low-frequency audio signals should be coded by using the frequency domain coding manner, the frequency domain bandwidth extension mode is selected to perform frequency domain coding for the high-frequency audio signals. That is, the coding manner of the high-frequency audio signals and the low-frequency coding manner belong to the same domain coding manner (time domain coding or frequency domain coding).

In another embodiment, the selected bandwidth extension mode corresponds to the low-frequency coding manner suitable for the characteristics of the audio signals: When the audio signals are voice signals, the time domain bandwidth extension mode is selected to perform time domain coding for the high-frequency audio signals; when the audio signals are music signals, the frequency domain bandwidth extension mode is selected to perform frequency domain coding for the high-frequency audio signals. That is, the coding manner of the high-frequency audio signals and the low-frequency coding manner that is suitable for the characteristics of the audio signals belong to the same domain coding manner (time domain coding or frequency domain coding).

In still another embodiment, with comprehensive consideration of the low-frequency coding manner and the characteristics of the audio signals, a bandwidth extension mode is selected to code the high-frequency audio signals: When the low-frequency audio signals should be coded by using the time domain coding manner and the audio signals are voice signals, the time domain bandwidth extension mode is selected to perform time domain coding for the high-frequency audio signals; otherwise, the frequency domain bandwidth extension mode is selected to perform frequency domain coding for the high-frequency audio signals.

Figure 4:
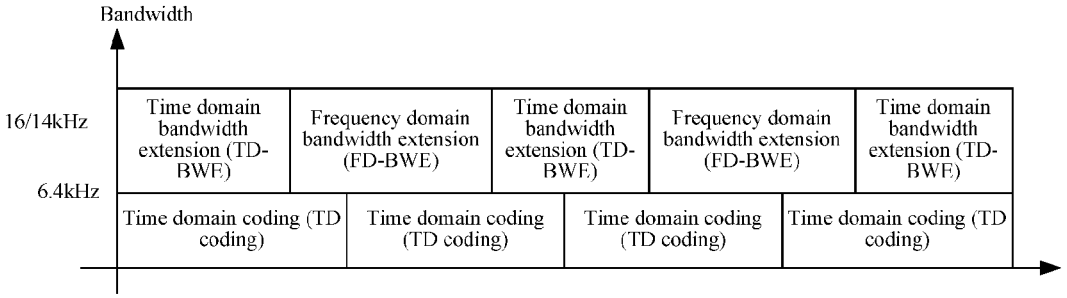
FIG. 4 is a first schematic diagram of bandwidth extension in the audio signal coding method according to an embodiment of the present invention.

Referring to FIG. 4, a first schematic diagram of bandwidth extension in the audio signal coding method according to an embodiment of the present invention is illustrated. Low-frequency audio signals, for example, audio signals at 0-6.4 kHz, may be coded by using time domain TD coding or frequency domain FD coding. Bandwidth extension of high-frequency audio signals, for example, audio signals at 6.4-16/14 kHz, may be time domain bandwidth extension TD-BWE or frequency domain bandwidth extension FD-BWE.

That is to say, in the audio signal coding method according to the embodiment of the present invention, a coding manner of the low-frequency audio signals and bandwidth extension of the high-frequency signals are not in one-to-one correspondence. For example, if the low-frequency audio signals are coded by using the time domain coding TD coding, the bandwidth extension of the high-frequency audio signals may be the time domain bandwidth extension TD-BWE, or may be the frequency domain bandwidth extension FD-BWE; if the low-frequency audio signals are coded by using the frequency domain coding FD coding, the bandwidth extension of the high-frequency audio signals may be the time domain bandwidth extension TD-BWE, or may be the frequency domain bandwidth extension FD-BWE.

Figure 5:
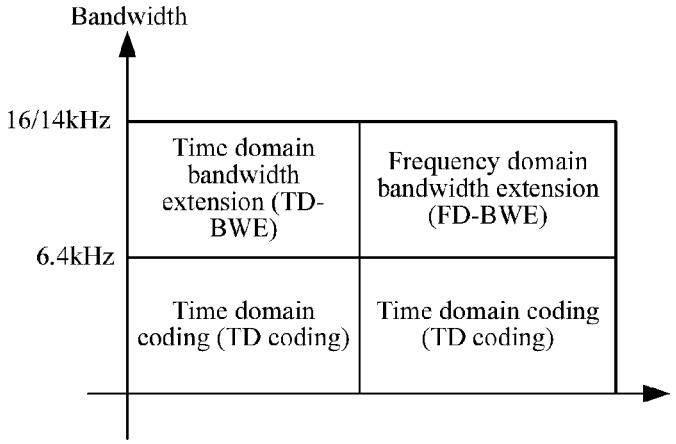
FIG. 5 is a second schematic diagram of bandwidth extension in the audio signal coding method according to an embodiment of the present invention.

Specifically, a manner for selecting a bandwidth extension mode to code the high-frequency audio signals is to perform processing according to the low-frequency coding manner of the low-frequency audio signals. For details, reference is made to a second schematic diagram of bandwidth extension in the audio signal coding method according to an embodiment of the present invention illustrated in FIG. 5. When the low-frequency (0-6.4 kHz) audio signals are coded by using the time domain coding TD coding, the high-frequency (6.4-16/14 kHz) audio signals are also coded by using the time domain coding of the time domain bandwidth extension TD-BWE; when the low-frequency (0-6.4 kHz) audio signals are coded by using the frequency domain coding FD coding, the high-frequency (6.4-16/14 kHz) audio signals are also coded by using the frequency domain coding of the frequency domain bandwidth extension FD-BWE.

Therefore, when the coding manner of the high-frequency audio signals and the coding manner of the low-frequency audio signals belong to the same domain, reference is not made to the characteristics of the audio signals/low-frequency audio signals. That is, the coding of the high-frequency audio signals is processed by referring to the coding manner of the low-frequency audio signals, instead of referring to the characteristics of the audio signals/low-frequency audio signals.

The coding manner for bandwidth extension to the high-frequency audio signals is determined according to the coding manner of the low-frequency audio signals, so that a case that the coding manner of the low-frequency audio signals is not considered during bandwidth extension can be avoided, the limitation caused by bandwidth extension to the coding quality of different audio signals is reduced, adaptive coding is implemented, and the audio coding quality is optimized.

Another manner for selecting the bandwidth extension mode to code the high-frequency audio signals is to perform processing according to the characteristics of the audio signals or low-frequency audio signals. For example, if the audio signals/low-frequency audio signals are voice audio signals, the high-frequency audio signals are coded by using the time domain coding; if the audio signals/low-frequency audio signals are music audio signals, the high-frequency audio signals are coded by using the frequency domain coding.

Still referring to FIG. 4, the coding for bandwidth extension of the high-frequency audio signal is performed by referring only to the characteristics of the audio signals/low-frequency audio signals, regardless of the coding manner of the low-frequency audio signals. Therefore, when the low-frequency audio signals are coded by using the time domain coding, the high-frequency audio signal may be coded by using the time domain coding or the frequency domain coding; when the low-frequency audio signals are coded by using the frequency domain coding, the high-frequency audio signals may be coded by using the frequency domain coding or the time domain coding.

The coding manner for bandwidth extension to the high-frequency audio signals is determined according to the characteristics of the audio signals/low-frequency audio signals, so that a case that the characteristics of the audio signals/low-frequency audio signals are not considered during bandwidth extension can be avoided, the limitation caused by bandwidth extension to the coding quality of different audio signals is reduced, adaptive coding is implemented, and the audio coding quality is optimized.

Still another manner for selecting the bandwidth extension mode to code the high-frequency audio signals is to perform processing according to both the coding manner of the low-frequency audio signals and the characteristics of the audio signals/low-frequency audio signals. For example, when the low-frequency audio signals should be coded by using the time domain coding manner and the audio signals/low-frequency audio signals are voice signals, the time domain bandwidth extension mode is selected to perform time domain coding for the high-frequency audio signals; when the low-frequency audio signals should be coded by using the frequency domain coding manner or the low-frequency audio signals should be coded by using the time domain coding manner, and the audio signals/low-frequency audio signals are music signals, the frequency domain bandwidth extension mode is selected to perform frequency domain coding for the high-frequency audio signals.

Figure 6:
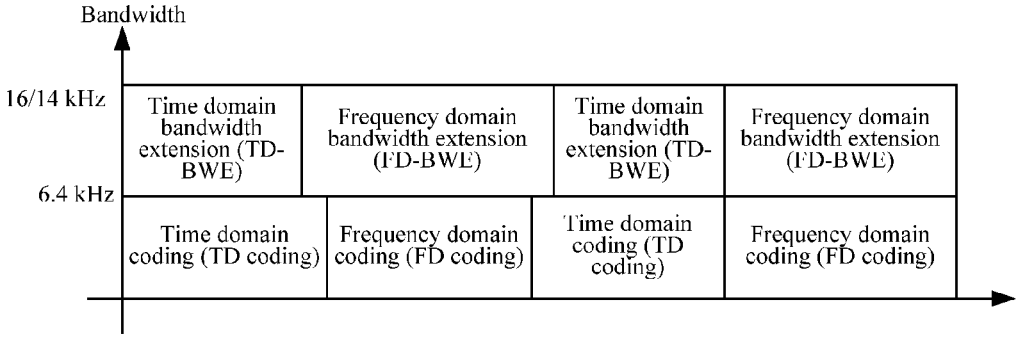
FIG. 6 is a third schematic diagram of bandwidth extension in the audio signal coding method according to an embodiment of the present invention.

FIG. 6 is a third schematic diagram of bandwidth extension in the audio signal coding method according to an embodiment of the present invention. As shown in FIG. 6, when low-frequency (0-6.4 kHz) audio signals are coded by using time domain coding TD coding, high-frequency (6.4-16/14 kHz) audio signals may be coded by using frequency domain coding of frequency domain bandwidth extension FD-BWE, or time domain coding of time domain bandwidth extension TD-BWE; when the low-frequency (0-6.4 kHz) audio signals are coded by using frequency domain coding FD coding, the high-frequency (6.4-16/14 kHz) audio signals are also coded by using the frequency domain coding of the frequency domain bandwidth extension FD-BWE.

A coding manner for bandwidth extension to the high-frequency audio signals is determined according to a coding manner of the low-frequency audio signals and characteristics of the audio signals/low-frequency audio signals, so that a case that the coding manner of the low-frequency audio signals and the characteristics of the audio signals/low-frequency audio signals are not considered during bandwidth extension can be avoided, the limitation caused by bandwidth extension to the coding quality of different audio signals is reduced, adaptive coding is implemented, and the audio coding quality is optimized.

In the audio signal coding method according to the embodiment of the present invention, the coding manner of the low-frequency audio signals may be the time domain coding or the frequency domain coding. In addition, two manners are available for bandwidth extension, that is, the time domain bandwidth extension and the frequency domain bandwidth extension, which may correspond to different low-frequency coding manners.

Delay in the time domain bandwidth extension and delay in the frequency domain bandwidth extension may be different, so delay alignment is required, to reach unified delay.

It is assumed that coding delay of all low-frequency audio signals is the same, it is better that the delay in the time domain bandwidth extension and the delay in the frequency domain bandwidth extension are the same. Generally, the delay in the time domain bandwidth extension is fixed, whereas the delay in the frequency domain bandwidth extension is adjustable. Therefore, unified delay may be implemented by adjusting the delay in the frequency domain bandwidth extension.

Figure 7:
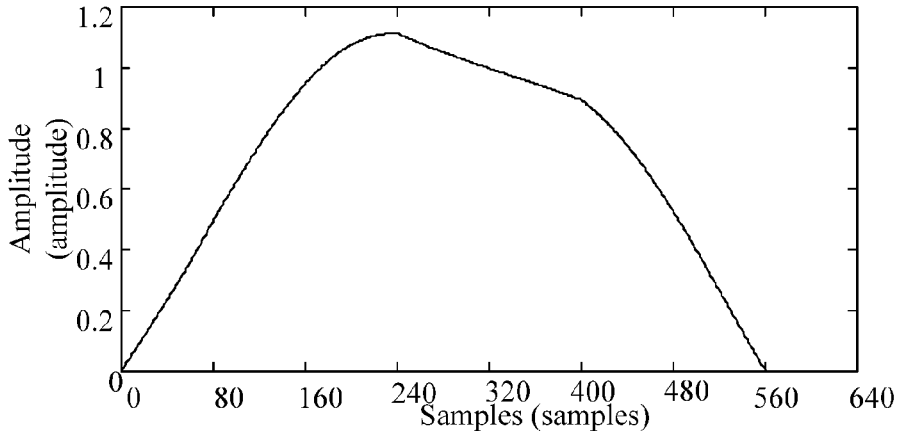
FIG. 7 is a schematic diagram of an analyzing window in ITU-T G.718.

According to this embodiment of the present invention, bandwidth extension with zero delay relative to the decoding of the low-frequency audio signals may be implemented. Here, the zero delay is relative to a low frequency band because an asymmetric window inheritably has delay. In addition, according to this embodiment of the present invention, different windowing may be performed for the high-frequency signals. Here, the asymmetric window is used, for example, the analyzing window in ITU-T G.718 illustrated in FIG. 7. Further, any delay between the zero delay relative to decoding of the low-frequency audio signals and the delay of a high-frequency window relative to decoding of the low-frequency audio signals can be implemented as shown in FIG. 8.

Figure 8:
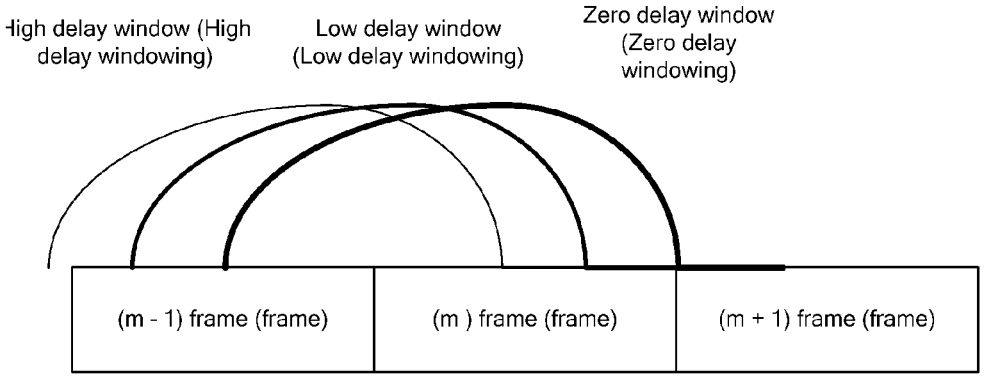
FIG. 8 is a schematic diagram of windowing of different high-frequency audio signals in the audio signal coding method according to the present invention.

FIG. 8 is a schematic diagram of windowing to different high-frequency audio signals in the audio signal coding method according to the present invention. As shown in FIG. 8, as regard different frames (frames), for example, a (m−1) frame, a (m) frame, and a (m+1) frame, the high delay windowing (High delay windowing) of the high-frequency signals, low delay windowing (Low delay windowing) of the high-frequency signals, and zero delay windowing (Zero delay windowing) of the high-frequency signals may be implemented. Each delay windowing of the high-frequency signals does not consider the delay of the windowing, but considers only different windowing manners of the high-frequency signals.

Figure 9:
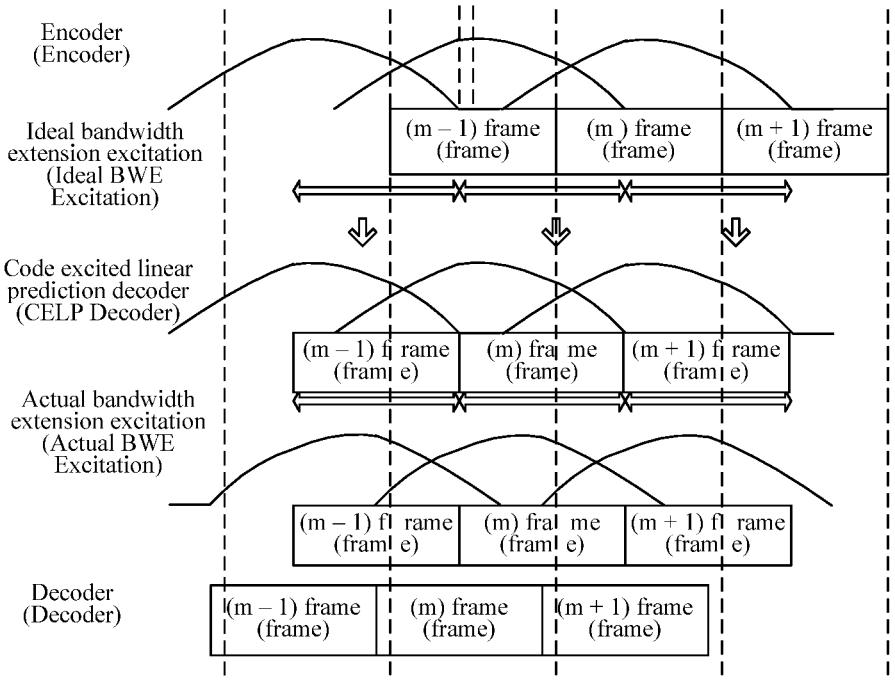
FIG. 9 is a schematic diagram of BWE based on high delay windowing of high-frequency signals in the audio signal coding method according to the present invention.

FIG. 9 is a schematic diagram of BWE based on high delay windowing of high-frequency signals in the audio signal coding method according to the present invention. As shown in FIG. 9, when low-frequency audio signals of input frames are completely decoded, the decoded low-frequency audio signals are used as high-frequency excitation signals. Windowing to the high-frequency audio signals of the input frames is determined according to the decoding delay of the low-frequency audio signals of the input frames.

For example, the coded and decoded low-frequency audio signal have the delay of D1 ms. When an Encoder encoder at a coding end performs time-frequency transforming for the high-frequency audio signals, time-frequency transforming is performed for the high-frequency audio signals having the delay of D1 ms, and the windowing transform of the high-frequency audio signals may generate the delay of D2 ms. Therefore, the total delay of the high-frequency signals decoded by a Decoder decoder at a decoding end is D1+D2 ms. In this way, compared with the decoded low-frequency audio signals, the high-frequency audio signals have the additional delay of D2 ms. That is, the decoded low-frequency audio signals need the additional delay of D2 ms to align with the delay of the decoded high-frequency audio signals, so that the total delay of the output signals is D1+D2 ms. However, at the decoding end, because high-frequency excitation signals need to be obtained from prediction of the low-frequency audio signals, time-frequency transforming is performed for both the low-frequency audio signals at the decoding end and the high-frequency audio signals at the coding end. Time-frequency transforming is performed for both the high-frequency audio signals at the coding end and the low-frequency audio signals at the decoding end after the delay of D1 ms, so the excitation signals are aligned.

Figure 10:
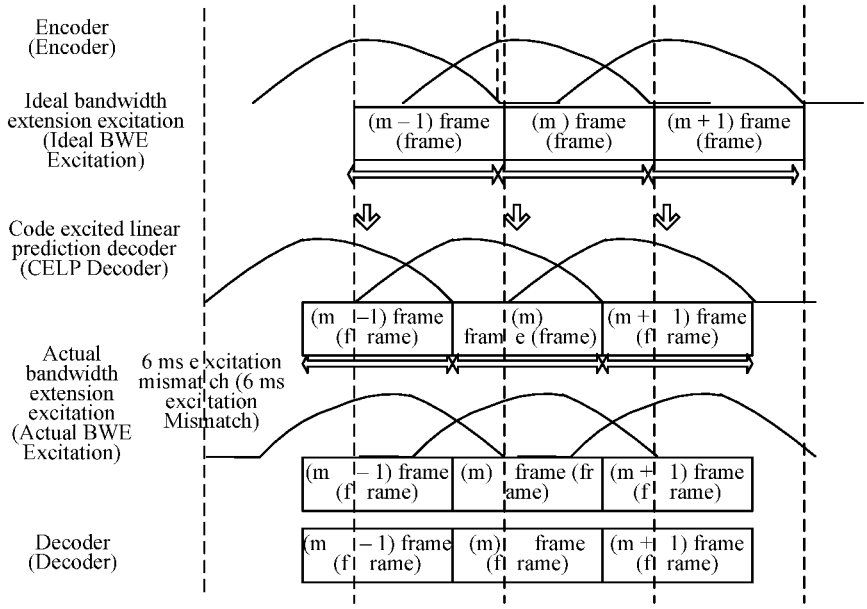
FIG. 10 is a schematic diagram of BWE based on zero delay windowing of high-frequency signals in the audio signal coding method according to the present invention.

FIG. 10 is a schematic diagram of BWE based on zero delay windowing of high-frequency signals in the audio signal coding method according to the present invention. As shown in FIG. 10, windowing is performed directly by a coding end for high-frequency audio signals of a currently received frame, during time-frequency transforming processing, a decoding end uses decoded low-frequency audio signals of a current frame as excitation signals. Although the excitation signals may be staggered, the impact of staggering may be ignored after the excitation signals are calibrated.

For example, the decoded low-frequency audio signals have the delay of D1 ms, whereas when the coding end performs time-frequency transforming for the high-frequency signals, delay processing is not performed, and windowing to the high-frequency signals may generate the delay of D2 ms, so the total delay of the high-frequency signals decoded at the decoding end is D2 ms.

When D1 is equal to D2, the decoded low-frequency audio signals do not need additional delay to align with the decoded high-frequency audio signals. However, the decoding end predicts that the high-frequency excitation signals are obtained from frequency signals that are obtained after time-frequency transforming is performed for the low-frequency audio signals that are delayed by D1 ms, so the high-frequency excitation signals do not align with low-frequency excitation signals, and the stagger of D1 ms exists. The decoded signals have the total delay of D1 ms or D2 ms, compared with the signals at the coding end.

When D1 is not equal to D2, for example, when D1 is smaller than D2, the decoded signals have the total delay of D2 ms compared with the signals at the coding end, the stagger between the high-frequency excitation signals and the low-frequency excitation signals is D1 ms, and the decoded low-frequency audio signals need the additional delay of (D2−D1) ms to align with the decoded high-frequency audio signals. For example, when D1 is larger than D2, the decoded signals have the total delay of D1 ms compared with the signals at the coding end, the stagger between the high-frequency excitation signals and the low-frequency excitation signals is D1 ms, and the decoded high-frequency audio signals need the additional delay of (D1−D2) ms to align with the decoded low-frequency audio signals.

The BWE between the zero-delay windowing and high-delay windowing of the high-frequency signals refers to that the coding end performs windowing for the high-frequency audio signals of the currently received frame after the delay of D3 ms. The delay ranges from 0 to D1 ms. During time-frequency transforming processing, the decoding end uses the decoded low-frequency audio signals of the current frame as the excitation signals. Although the excitation signals may be staggered, the impact of the stagger may be ignored after the excitation signals are calibrated.

When D1 is equal to D2, the decoded low-frequency audio signals need the additional delay of D3 ms to align with the high-frequency audio signals. However, the decoding end predicts that the high-frequency excitation signals are obtained from frequency signals that are obtained after time-frequency transforming is performed for the low-frequency audio signals that are delayed by D1 ms, so the high-frequency excitation signals do not align with the low-frequency excitation signals, and the stagger of D1−D3 ms exists. The decoded signals have the total delay of D2+D3 ms or D1+D3 ms compared with the signals at the coding end.

When D1 is not equal to D2, for example, when D1 is smaller than D2, the decoded signals have the total delay of (D2+D3) ms compared with the signals at the coding end, the stagger between the high-frequency excitation signals and the low-frequency excitation signals is (D1−D3) ms, and the decoded low-frequency audio signals need the additional delay of (D2+D3−D1) ms to align with the decoded high-frequency audio signals.

For example, when D1 is larger than D2, the decoded signals have the total delay of max (D1, D2+D3) ms compared with the signals at the coding end, the stagger between the high-frequency excitation signals and the low-frequency excitation signals is (D1−D3) ms, where max (a, b) indicates that a larger value between a and b is taken. When max (D1, D2+D3)=D2+D3, the decoded low-frequency audio signals need the additional delay of (D2+D3−D1) ms to align with the decoded high-frequency audio signals; when max (D1, D2+D3)=D1, the decoded high-frequency audio signals need the additional delay of (D1−D2−D3) ms to align with the decoded low-frequency audio signals. For example, when D3=(D1−D2) ms, the decoded signals have the total delay of D1 ms compared with the signals at the coding end, the stagger between the high-frequency excitation signals and the low-frequency excitation signals is D2 ms. In this case, the decoded low-frequency audio signals do not need the additional delay to align with the decoded high-frequency audio signals.

Therefore, in this embodiment of the present invention, during the time domain bandwidth extension, the status of the frequency domain bandwidth extension needs to be updated because a next frame may use the frequency domain bandwidth extension. Similarly, during the frequency domain bandwidth extension, the status of the time domain bandwidth extension needs to be updated because a next frame may use the time domain bandwidth extension. In this manner, continuity of bandwidth switching is implemented.

Figure 11:
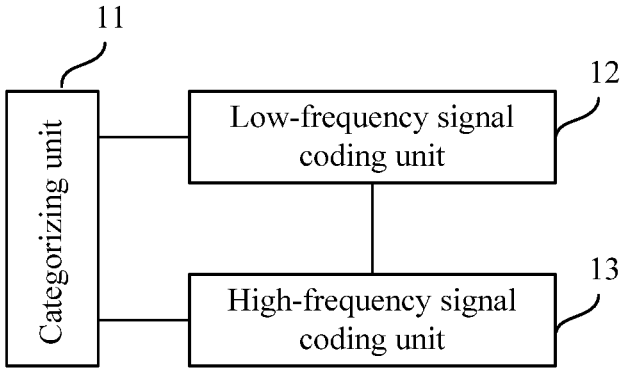
FIG. 11 is a schematic diagram of an audio signal processing apparatus according to an embodiment of the present invention.

The above embodiments are directed to the audio signal coding method according to the present invention, which may be implemented by using an audio signal processing apparatus. FIG. 11 is a schematic diagram of an audio signal processing apparatus according to an embodiment of the present invention. As shown in FIG. 11, the signal processing apparatus provided in this embodiment of the present invention specifically includes: a categorization unit 11, a low-frequency signal coding unit 12, and a high-frequency signal coding unit 13.

The categorizing unit 11 is configured to categorize audio signals into high-frequency audio signals and low-frequency audio signals. The low-frequency signal coding unit 12 is configured to code the low-frequency audio signals by using a corresponding low-frequency coding manner according to characteristics of the low-frequency audio signals, where the coding manner may be a time domain coding manner or a frequency domain coding manner. For example, as regard voice audio signals, low-frequency voice signals are coded by using time domain coding; as regard music audio signals, low-frequency music signals are coded by using frequency domain coding. Generally, a better effect is achieved when the voice signals are coded by using the time domain coding, whereas a better effect is achieved when the music signals are coded by using the frequency domain coding.

The high-frequency signal coding unit 13 is configured to select a bandwidth extension mode to code the high-frequency audio signals according to the low-frequency coding manner and/or characteristics of the audio signals.

Specifically, if the low-frequency signal coding unit 12 uses the time domain coding, the high-frequency signal coding unit 13 selects a time domain bandwidth extension mode to perform time domain coding or frequency domain coding for the high-frequency audio signals; if the low-frequency signal coding unit 12 uses the frequency domain coding, the high-frequency signal coding unit 13 selects a frequency domain bandwidth extension mode to perform time domain coding or frequency domain coding for the high-frequency audio signals.

In addition, if the audio signals/low-frequency audio signals are voice audio signals, the high-frequency signal coding unit 13 codes the high-frequency voice signals by using the time domain coding; if the audio signals/low-frequency audio signals are music audio signals, the high-frequency signal coding unit 13 codes the high-frequency music signals by using the frequency domain coding. In this case, the coding manner of the low-frequency audio signals is not considered.

Further, when the low-frequency signal coding unit 12 codes the low-frequency audio signals by using the time domain coding manner, and the audio signals/low-frequency audio signals are voice signals, the high-frequency signal coding unit 13 selects the time domain bandwidth extension mode to perform time domain coding for the high-frequency audio signals; when the low-frequency signal coding unit 12 codes the low-frequency audio signals by using the frequency domain coding manner or the low-frequency signal coding unit 12 codes the low-frequency audio signals by using the time domain coding manner and the audio signals/low-frequency audio signals are music signals, the high-frequency signal coding unit 13 selects the frequency domain bandwidth extension mode to perform frequency domain coding for the high-frequency audio signals.

Figure 12:
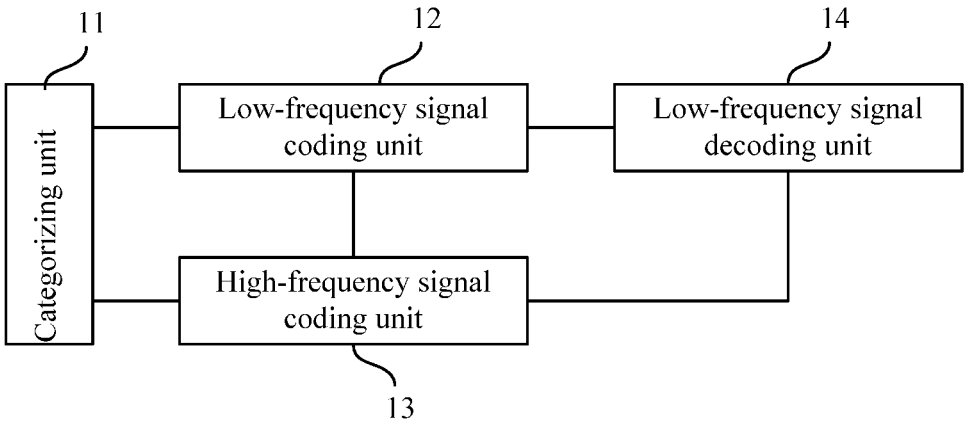
FIG. 12 is a schematic diagram of another audio signal processing apparatus according to an embodiment of the present invention.

FIG. 12 is a schematic diagram of another audio signal processing apparatus according to an embodiment of the present invention. As shown in FIG. 12, the signal processing apparatus according to this embodiment of the present invention further specifically includes: a low-frequency signal decoding unit 14.

The low-frequency signal decoding unit 14 is configured to decode the low-frequency audio signals; where first delay D1 is generated during the coding and decoding of the low-frequency audio signals.

Specifically, if the high-frequency audio signals have a delay window, the high-frequency signal coding unit 13 is configured to code the high-frequency audio signals after delaying the high-frequency audio signals by the first delay D1, where second delay D2 is generated during the coding of the high-frequency audio signals, so that coding delay and decoding delay of the audio signals are the sum of the first delay D1 and a second delay D2, that is, (D1+D2).

If the high-frequency audio signals have no delay window, the high-frequency signal coding unit 13 is configured to code the high-frequency audio signals, where the second delay D2 is generated during the coding of the high-frequency audio signals. When the first delay D1 is smaller than or equal to the second delay D2, after coding the low-frequency audio signals, the low-frequency signal coding unit 12 delays the coded low-frequency audio signals by the difference (D2−D1) between the second delay D2 and the first delay D1, so that coding delay and decoding delay of the audio signals are the second delay D2; when the first delay D1 is larger than the second delay D2, the low-frequency signal coding unit 12 is configured to after coding the high-frequency audio signals, delay the coded high-frequency audio signals by the difference (D1−D2) between the first delay D1 and the second delay D2, so that coding delay and decoding delay of the audio signals are the first delay D1.

If the high-frequency audio signals have a delay window whose delay is between zero and a high delay, the high-frequency signal coding unit 13 is configured to, after delaying the high-frequency audio signals by third delay D3, code the delayed high-frequency audio signals, where the second delay D2 is generated during the coding of the high-frequency signals. When the first delay is smaller than or equal to the second delay, after coding the low-frequency audio signals, the low-frequency signal coding unit 12 delays the coded low-frequency audio signals by the difference (D2+D3−D1) between the sum of the second delay D2 and the third delay D3, and the first delay D1, so that coding delay and decoding delay of the audio signals are the sum of the second delay D2 and the third delay D3, that is, (D2+D3). When the first delay is larger than the second delay, two possibilities exist: if the first delay D1 is larger than or equal to the sum (D2+D3) of the second delay D2 and the third delay D3, after coding the high-frequency audio signals, the high-frequency signal coding unit 13 delays the coded high-frequency audio signals by the difference (D1−D2−D3) between the first delay D1 and the sum of the second delay D2 and the third delay D3; if the first delay D1 is smaller than the sum (D2+D3) of the second delay D2 and the third delay D3, after coding the low-frequency audio signals, the low-frequency signal coding unit 12 delays the coded low-frequency audio signals by the difference (D2+D3−D1) between the sum of the second delay D2 and the third delay D3, and the first delay D1, so that coding delay and decoding delay of the audio signals are the first delay D1 or the sum (D2+D3) of the second delay D2 and the third delay D3.

With the audio signal coding apparatus provided in this embodiment of the present invention, the coding manner for bandwidth extension to the high-frequency audio signals may be determined according to the coding manner of the low-frequency audio signals and the characteristics of the audio signals/low-frequency audio signals, so that a case that the coding manner of the low-frequency audio signals and the characteristics of the audio signals/low-frequency audio signals are not considered during bandwidth extension can be avoided, the limitation caused by bandwidth extension to the coding quality of different audio signals is reduced, adaptive coding is implemented, and the audio coding quality is optimized.

Those skilled in the art may further understand that the exemplary units and algorithm steps described in the embodiments of the present invention may be implemented in the form of electronic hardware, computer software, or the combination of the hardware and software. To clearly describe the exchangeability of the hardware and software, the constitution and steps of each embodiment are described by general functions. Whether the functions are implemented in hardware or software depends on specific applications of the technical solutions and limitation conditions of the design. Those skilled in the art may use different methods to implement the described functions for the specific applications. However, the implementation shall not be considered to go beyond the scope of the present invention.

The steps of the method or algorithms according to the embodiments of the present invention can be executed by the hardware or software module enabled by the processor, or executed by a combination thereof. The software module may be stored in a random access memory (RAM), a memory, a read-only memory (ROM), an electrically programmable ROM, an electrically erasable programmable ROM, a register, a hard disk, a movable hard disk, a compact disc-read only memory (CD-ROM), or any other storage medium commonly known in the art.

The objectives, technical solutions, and beneficial effects of the present invention are described in detail in above embodiments. It should be understood that the above descriptions are only about the exemplary embodiments of the present invention, but not intended to limit the protection scope of the present invention. Any modification, equivalent replacement, and improvement made without departing from the idea and principle of the present invention shall fall into the protection scope of the present invention.

What is claimed is:

1. An audio signal coding method, comprising:

categorizing, by a categorizing unit of an encoder, audio signals into high-frequency audio signals and low-frequency audio signals;

coding, by a low-frequency signal coding unit of an encoder, the low-frequency audio signals by using a time domain coding manner or a frequency domain coding manner; and selecting, by a high-frequency signal coding unit of an encoder, a bandwidth extension mode to code the high-frequency audio signals according to a low-frequency coding manner or characteristics of the audio signals; and wherein selecting the bandwidth extension mode to code the high-frequency audio signals according to the low-frequency coding manner comprises if the low-frequency audio signals should be coded by using the time domain coding manner, selecting a time domain bandwidth extension mode to perform time domain coding for the high-frequency audio signals.

2. The audio signal coding method according to claim 1, wherein the selecting the bandwidth extension mode to code the high-frequency audio signals according to the low-frequency coding manner comprises determining that the frequency domain bandwidth extension mode to perform frequency domain coding for the high-frequency audio signals.

3. The audio signal coding method according to claim 1, wherein the selecting the bandwidth extension mode to code the high-frequency audio signals according to the characteristics of the audio signals specifically is: if the audio signals are voice signals, selecting a time domain bandwidth extension mode to perform time domain coding for the high-frequency audio signals; if the audio signals are music signals, selecting a frequency domain bandwidth extension mode to perform frequency domain coding for the high-frequency audio signals.

4. The audio signal coding apparatus according to claim 1, further comprising: performing delay processing on the high-frequency audio signals or the low-frequency audio signals, so that delay of the high-frequency audio signals and delay of the low-frequency audio signals are the same at a decoding end.

5. The audio signal coding method according to claim 1, wherein the coding the high-frequency audio signals specifically comprises: coding the high-frequency audio signals after performing first delay for the high-frequency audio signals, so that coding delay and decoding delay of the audio signals are a sum of the first delay and second delay; wherein the first delay is delay generated during coding and decoding of the low-frequency audio signals, and the second delay is delay generated during coding of the high-frequency audio signals.

6. The audio signal coding method according to claim 1, wherein when first delay is smaller or equal to than second delay, the low-frequency audio signals are delayed by a difference between the second delay and the first delay after being coded, so that coding delay and decoding delay of the audio signals are the second delay; when first delay is larger than second delay, the high-frequency audio signals are delayed by a difference between the first delay and the second delay after being coded, so that coding delay and decoding delay of the audio signals are the first delay; wherein the first delay is delay generated during coding and decoding of the low-frequency audio signals, and the second delay is delay generated during coding of the high-frequency audio signals.

7. The audio signal coding method according to claim 1, wherein the coding the high-frequency audio signals specifically is: coding the high-frequency audio signals after performing third delay for the high-frequency audio signals;

when first delay is smaller than or equal to second delay, the low-frequency audio signals are delayed by a difference between a sum of the second delay and the third delay, and the first delay after being coded, so that coding delay and decoding delay of the audio signals are the sum of the second delay and the third delay; when first delay is larger than second delay, the high-frequency audio signals are delayed by a difference between the first delay and a sum of the second delay and the third delay after being coded, or the low-frequency audio signals are delayed by a difference between a sum of the second delay and the third delay, and the first delay, so that coding delay and decoding delay of the audio signals are the first delay or the sum of the second delay and the third delay.

8. An audio signal coding apparatus, comprising:

a categorizing unit, configured on a processor to categorize audio signals into high-frequency audio signals and low-frequency audio signals;

a low-frequency signal coding unit, configured on a processor to code the low-frequency audio signals by using a time domain coding manner or a frequency domain coding manner; and a high-frequency signal coding unit, configured on a processor to select a bandwidth extension mode to code the high-frequency audio signals according to a low-frequency coding manner and/or characteristics of the audio signals; and wherein the high-frequency signal coding unit is specifically configured to select a time domain bandwidth extension mode to perform time domain coding for the high-frequency audio signals if the low-frequency audio signals should be coded by using the time domain coding manner; select a frequency domain bandwidth extension mode to perform frequency domain coding for the high-frequency audio signals if the low-frequency audio signals should be coded by using the frequency domain coding manner.

9. The audio signal coding apparatus according to claim 8, wherein if the audio signals are voice signals, the high-frequency signal coding unit is specifically configured to select a time domain bandwidth extension mode to perform time domain coding for the high-frequency audio signals; if the audio signals are music signals, the high-frequency signal coding unit is specifically configured to select a frequency domain bandwidth extension mode to perform frequency domain coding for the high-frequency audio signals.

10. The audio signal coding apparatus according to claim 8, further comprising:

a low-frequency signal decoding unit, configured to decode the low-frequency audio signals; wherein first delay is generated during the coding and decoding of the low-frequency audio signals;

wherein the high-frequency signal coding unit is specifically configured to after delaying the high-frequency audio signals by the first delay, code the delayed high-frequency audio signals, so that coding delay and decoding delay of the audio signals are a sum of the first delay and second delay, wherein the second delay is generated during the coding of the high-frequency audio signals.

11. The audio signal coding apparatus according to claim 8, wherein:

when first delay is smaller than or equal to second delay, the low-frequency signal coding unit is configured to after coding the low-frequency audio signals, delay the coded low-frequency audio signals by a difference between the second delay and the first delay, so that coding delay and decoding delay of the audio signals are the second delay; when first delay is larger than second delay, the high-frequency signal coding unit is configured to after coding the high-frequency audio signals, delay the coded high-frequency signals by a difference between the first delay and the second delay, so that coding delay and decoding delay of the audio signals are the first delay; wherein the first delay is delay generated during coding and decoding of the low-frequency audio signals, and the second delay is delay generated during coding of the high-frequency audio signals.

12. The audio signal coding apparatus according to claim 8, wherein:

the high-frequency signal coding unit is specifically configured to code the high-frequency audio signals after performing third delay for the high-frequency audio signals; and when first delay is smaller than or equal to second delay, the low-frequency signal coding unit is configured to after coding the low-frequency audio signals, delay the coded low-frequency audio signals by a difference between a sum of the second delay and the third delay, and the first delay, so that coding delay and decoding delay of the audio signals are the sum of the second delay and the third delay; when first delay is larger than second delay, the high-frequency signal coding unit is configured to after coding the high-frequency audio signals, delay the coded high-frequency audio signals by a difference between the first delay and a sum of the second delay and the third delay, or the low-frequency signal coding unit after coding the low-frequency audio signals, delays the coded low-frequency audio signals by a difference between a sum of the second delay and the third delay, and the first delay after coding the low-frequency audio signals, so that coding delay and decoding delay of the audio signals are the first delay or the sum of the second delay and the third delay; wherein the first delay is delay generated during coding and decoding of the low-frequency audio signals, and the second delay is delay generated during coding of the high-frequency audio signals.

13. An audio signal coding method, comprising:

categorizing, by a categorizing unit on an encoder, audio signals into high-frequency audio signals and low-frequency audio signals;

coding, by a low-frequency signal coding unit on an encoder, the low-frequency audio signals by using a time domain coding manner or a frequency domain coding manner; and selecting, by a high-frequency signal coding unit on an encoder, a bandwidth extension mode to code the high-frequency audio signals according to a low-frequency coding manner or characteristics of the audio signals; and wherein the selecting the bandwidth extension mode to code the high-frequency audio signals according to the low-frequency coding manner and the characteristics of the audio signals specifically is: if the low-frequency audio signals should be coded by using the time domain coding manner and the audio signals are voice signals, selecting a time domain bandwidth extension mode to perform time domain coding for the high-frequency audio signals; otherwise, selecting a frequency domain bandwidth extension mode to perform frequency domain coding for the high-frequency audio signals.

14. The audio signal coding method according to claim 13, wherein the selecting the bandwidth extension mode to code the high-frequency audio signals according to the low-frequency coding manner comprises determining that the frequency domain bandwidth extension mode to perform frequency domain coding for the high-frequency audio signals.

15. The audio signal coding method according to claim 13, wherein the selecting the bandwidth extension mode to code the high-frequency audio signals according to the characteristics of the audio signals specifically is: if the audio signals are voice signals, selecting a time domain bandwidth extension mode to perform time domain coding for the high-frequency audio signals; if the audio signals are music signals, selecting a frequency domain bandwidth extension mode to perform frequency domain coding for the high-frequency audio signals.

16. The audio signal coding apparatus according to claim 13, further comprising:

performing delay processing on the high-frequency audio signals or the low-frequency audio signals, so that delay of the high-frequency audio signals and delay of the low-frequency audio signals are the same at a decoding end.

17. The audio signal coding method according to claim 13, wherein the coding the high-frequency audio signals specifically comprises: coding the high-frequency audio signals after performing first delay for the high-frequency audio signals, so that coding delay and decoding delay of the audio signals are a sum of the first delay and second delay; wherein the first delay is delay generated during coding and decoding of the low-frequency audio signals, and the second delay is delay generated during coding of the high-frequency audio signals.

18. The audio signal coding method according to claim 13, wherein when first delay is smaller or equal to than second delay, the low-frequency audio signals are delayed by a difference between the second delay and the first delay after being coded, so that coding delay and decoding delay of the audio signals are the second delay; when first delay is larger than second delay, the high-frequency audio signals are delayed by a difference between the first delay and the second delay after being coded, so that coding delay and decoding delay of the audio signals are the first delay; wherein the first delay is delay generated during coding and decoding of the low-frequency audio signals, and the second delay is delay generated during coding of the high-frequency audio signals.

19. The audio signal coding method according to claim 13, wherein the coding the high-frequency audio signals specifically is: coding the high-frequency audio signals after performing third delay for the high-frequency audio signals;

when first delay is smaller than or equal to second delay, the low-frequency audio signals are delayed by a difference between a sum of the second delay and the third delay, and the first delay after being coded, so that coding delay and decoding delay of the audio signals are the sum of the second delay and the third delay; when first delay is larger than second delay, the high-frequency audio signals are delayed by a difference between the first delay and a sum of the second delay and the third delay after being coded, or the low-frequency audio signals are delayed by a difference between a sum of the second delay and the third delay, and the first delay, so that coding delay and decoding delay of the audio signals are the first delay or the sum of the second delay and the third delay.

20. An audio signal coding apparatus, comprising:

a categorizing unit, configured on a processor to categorize audio signals into high-frequency audio signals and low-frequency audio signals;

a low-frequency signal coding unit, configured on a processor to code the low-frequency audio signals by using a time domain coding manner or a frequency domain coding manner; and a high-frequency signal coding unit, configured on a processor to select a bandwidth extension mode to code the high-frequency audio signals according to a low-frequency coding manner and/or characteristics of the audio signals; and wherein the high-frequency signal coding unit is specifically configured to select a time domain bandwidth extension mode to perform time domain coding for the high-frequency audio signals if the low-frequency audio signals should be coded by using the time domain coding manner and the audio signals are voice signals; otherwise, select a frequency domain bandwidth extension mode to perform frequency domain coding for the high-frequency audio signals.

21. The audio signal coding apparatus according to claim 20, wherein if the audio signals are voice signals, the high-frequency signal coding unit is specifically configured to select a time domain bandwidth extension mode to perform time domain coding for the high-frequency audio signals; if the audio signals are music signals, the high-frequency signal coding unit is specifically configured to select a frequency domain bandwidth extension mode to perform frequency domain coding for the high-frequency audio signals.

22. The audio signal coding apparatus according to claim 20, further comprising:

a low-frequency signal decoding unit, configured to decode the low-frequency audio signals; wherein first delay is generated during the coding and decoding of the low-frequency audio signals;

wherein the high-frequency signal coding unit is specifically configured to after delaying the high-frequency audio signals by the first delay, code the delayed high-frequency audio signals, so that coding delay and decoding delay of the audio signals are a sum of the first delay and second delay, wherein the second delay is generated during the coding of the high-frequency audio signals.

23. The audio signal coding apparatus according to claim 20, wherein:

the high-frequency signal coding unit is specifically configured to code the high-frequency audio signals after performing third delay for the high-frequency audio signals; and when first delay is smaller than or equal to second delay, the low-frequency signal coding unit is configured to after coding the low-frequency audio signals, delay the coded low-frequency audio signals by a difference between a sum of the second delay and the third delay, and the first delay, so that coding delay and decoding delay of the audio signals are the sum of the second delay and the third delay; when first delay is larger than second delay, the high-frequency signal coding unit is configured to after coding the high-frequency audio signals, delay the coded high-frequency audio signals by a difference between the first delay and a sum of the second delay and the third delay, or the low-frequency signal coding unit after coding the low-frequency audio signals, delays the coded low-frequency audio signals by a difference between a sum of the second delay and the third delay, and the first delay after coding the low-frequency audio signals, so that coding delay and decoding delay of the audio signals are the first delay or the sum of the second delay and the third delay; wherein the first delay is delay generated during coding and decoding of the low-frequency audio signals, and the second delay is delay generated during coding of the high-frequency audio signals.

24. An audio signal coding apparatus, comprising:

a categorizing unit, configured on a processor to categorize audio signals into high-frequency audio signals and low-frequency audio signals;

a low-frequency signal coding unit, configured on a processor to code the low-frequency audio signals by using a time domain coding manner or a frequency domain coding manner; and a high-frequency signal coding unit, configured on a processor to select a bandwidth extension mode to code the high-frequency audio signals according to a low-frequency coding manner and/or characteristics of the audio signals; and wherein:

when first delay is smaller than or equal to second delay, the low-frequency signal coding unit is configured to after coding the low-frequency audio signals, delay the coded low-frequency audio signals by a difference between the second delay and the first delay, so that coding delay and decoding delay of the audio signals are the second delay; when first delay is larger than second delay, the high-frequency signal coding unit is configured to after coding the high-frequency audio signals, delay the coded high-frequency signals by a difference between the first delay and the second delay, so that coding delay and decoding delay of the audio signals are the first delay; wherein the first delay is delay generated during coding and decoding of the low-frequency audio signals, and the second delay is delay generated during coding of the high-frequency audio signals.

25. The audio signal coding apparatus according to claim 24, wherein the high-frequency signal coding unit is specifically configured to select a time domain bandwidth extension mode to perform time domain coding for the high-frequency audio signals if the low-frequency audio signals should be coded by using the time domain coding manner; select a frequency domain bandwidth extension mode to perform frequency domain coding for the high-frequency audio signals if the low-frequency audio signals should be coded by using the frequency domain coding manner.

26. The audio signal coding apparatus according to claim 24, wherein if the audio signals are voice signals, the high-frequency signal coding unit is specifically configured to select a time domain bandwidth extension mode to perform time domain coding for the high-frequency audio signals; if the audio signals are music signals, the high-frequency signal coding unit is specifically configured to select a frequency domain bandwidth extension mode to perform frequency domain coding for the high-frequency audio signals.

27. The audio signal coding apparatus according to claim 24, wherein the high-frequency signal coding unit is specifically configured to select a time domain bandwidth extension mode to perform time domain coding for the high-frequency audio signals if the low-frequency audio signals should be coded by using the time domain coding manner and the audio signals are voice signals; otherwise, select a frequency domain bandwidth extension mode to perform frequency domain coding for the high-frequency audio signals.

28. The audio signal coding apparatus according to claim 24, further comprising:

a low-frequency signal decoding unit, configured to decode the low-frequency audio signals; wherein first delay is generated during the coding and decoding of the low-frequency audio signals;

wherein the high-frequency signal coding unit is specifically configured to after delaying the high-frequency audio signals by the first delay, code the delayed high-frequency audio signals, so that coding delay and decoding delay of the audio signals are a sum of the first delay and second delay, wherein the second delay is generated during the coding of the high-frequency audio signals.

29. The audio signal coding apparatus according to claim 24, wherein:

the high-frequency signal coding unit is specifically configured to code the high-frequency audio signals after performing third delay for the high-frequency audio signals; and when first delay is smaller than or equal to second delay, the low-frequency signal coding unit is configured to after coding the low-frequency audio signals, delay the coded low-frequency audio signals by a difference between a sum of the second delay and the third delay, and the first delay, so that coding delay and decoding delay of the audio signals are the sum of the second delay and the third delay; when first delay is larger than second delay, the high-frequency signal coding unit is configured to after coding the high-frequency audio signals, delay the coded high-frequency audio signals by a difference between the first delay and a sum of the second delay and the third delay, or the low-frequency signal coding unit after coding the low-frequency audio signals, delays the coded low-frequency audio signals by a difference between a sum of the second delay and the third delay, and the first delay after coding the low-frequency audio signals, so that coding delay and decoding delay of the audio signals are the first delay or the sum of the second delay and the third delay; wherein the first delay is delay generated during coding and decoding of the low-frequency audio signals, and the second delay is delay generated during coding of the high-frequency audio signals.

* * * * *